US010246841B2

(12) United States Patent
Ladkat

(10) Patent No.: US 10,246,841 B2
(45) Date of Patent: Apr. 2, 2019

(54) SYSTEM FOR AERATION AND SEPERATION OF CONTAMINANTS FROM FLOWING WATER

(71) Applicant: Rajendra Vithal Ladkat, Pune (IN)

(72) Inventor: Rajendra Vithal Ladkat, Pune (IN)

( * ) Notice: Subject to any disclaimer, the term of this patent is extended or adjusted under 35 U.S.C. 154(b) by 0 days.

(21) Appl. No.: 15/736,786

(22) PCT Filed: Jun. 15, 2016

(86) PCT No.: PCT/IN2016/000156
§ 371 (c)(1),
(2) Date: Dec. 15, 2017

(87) PCT Pub. No.: WO2016/203493
PCT Pub. Date: Dec. 22, 2016

(65) Prior Publication Data

US 2018/0171571 A1 Jun. 21, 2018

(30) Foreign Application Priority Data

Jun. 17, 2015 (IN) ..... 2315/MUM/2015

(51) Int. Cl.

| | |
|---|---|
| ***E02B 8/02*** | (2006.01) |
| ***E02B 3/02*** | (2006.01) |
| ***E02B 3/06*** | (2006.01) |
| ***E02B 15/08*** | (2006.01) |
| ***E02B 1/00*** | (2006.01) |
| ***E02B 5/08*** | (2006.01) |
| ***B01F 3/04*** | (2006.01) |

(52) U.S. Cl.
CPC ..... *E02B 1/003* (2013.01); *B01F 3/04099* (2013.01); *E02B 3/02* (2013.01); *E02B 3/023* (2013.01); *E02B 3/06* (2013.01); *E02B 5/08* (2013.01); *E02B 8/02* (2013.01); *E02B 15/0814* (2013.01)

(58) Field of Classification Search
CPC . E02B 1/003; E02B 3/023; E02B 6/14; E02B 8/02; E02B 15/06; E02B 15/0814; E02B 15/0835
See application file for complete search history.

(56) References Cited

U.S. PATENT DOCUMENTS 2,442,358 A * 6/1948 Harp ..... E02B 8/02 210/170.1
3,462,132 A * 8/1969 Kaelin ..... B01F 3/04773 239/17

(Continued)

FOREIGN PATENT DOCUMENTS

CA 2363429 A1 * 5/2003 ..... E02B 3/04
WO WO-2005058762 A1 * 6/2005 ..... C02F 1/24

*Primary Examiner* — Frederick L Lagman
(74) *Attorney, Agent, or Firm* — Booth Udall Fuller, PLC

(57) ABSTRACT

A system for aeration and separation of contaminants from flowing water in a channel, comprising: a wall (1) partially embedded in the channel of flowing water; a mesh (4) placed above the wall (1); a plurality of baffles (3, 5) partially embedded in the channel and placed opposite to each other in such manner so as to the increase the distance travelled by water; plants algae planted around and on the baffles (3, 5); a flooring (6) sloping towards flowing water direction; a sink (2) constructed at a depth lower than the flooring (6); and a water wheel (11) placed in flowing water.

11 Claims, 4 Drawing Sheets

(56) References Cited

U.S. PATENT DOCUMENTS 3,671,022 A * 6/1972 Laird ..... B01F 3/04609 210/170.09
3,884,810 A * 5/1975 Smyrnow ..... E02B 1/003 210/170.1
3,887,459 A * 6/1975 McLaughlin ..... C02F 1/00 210/622
4,813,812 A * 3/1989 Hasegawa ..... E02B 3/14 405/16
4,824,284 A * 4/1989 Akai ..... C02F 7/00 405/21
4,876,004 A * 10/1989 Verhoeff ..... B01D 17/0208 210/170.08
5,106,504 A * 4/1992 Murray ..... C02F 3/1215 210/170.03
5,154,537 A * 10/1992 DeVries ..... E02B 3/02 405/211
5,228,800 A * 7/1993 Akai ..... E02B 3/06 405/21
5,514,285 A * 5/1996 Rizk ..... B01F 3/0473 210/739
5,938,936 A * 8/1999 Hodges ..... B01D 29/05 210/705
6,000,880 A * 12/1999 Halus ..... E02B 9/00 405/36
6,267,533 B1 * 7/2001 Bourg ..... E02B 3/04 405/16
7,074,328 B2 * 7/2006 O'Hara ..... B01F 3/04248 210/199
7,150,239 B2 * 12/2006 Blumenthal ..... B63B 35/00 114/40
7,179,387 B2 * 2/2007 DeBusk ..... C02F 1/52 210/198.1
7,226,242 B2 * 6/2007 LeBuffe ..... E02B 3/023 405/74
9,797,106 B1 * 10/2017 Smith ..... E02B 3/14
9,834,898 B2 * 12/2017 Chen ..... E02B 3/10
9,850,149 B2 * 12/2017 Fulford ..... C02F 3/103
2006/0018716 A1 * 1/2006 LeBuffe ..... E02B 3/023 405/50
2008/0075535 A1 * 3/2008 Han ..... E02B 3/04 405/16
2009/0022549 A1 * 1/2009 Wartmann ..... E02B 3/023 405/60
2011/0108472 A1 * 5/2011 Kania ..... A01G 31/02 210/151
2012/0012516 A1 * 1/2012 Torres Junco ..... C02F 3/327 210/242.1
2013/0125825 A1 * 5/2013 Kania ..... E02B 3/046 119/221
2014/0314484 A1 * 10/2014 Pierce, Jr. ..... E02B 3/06 405/31
2014/0326648 A1 * 11/2014 Gomes De Oliveira ..... C02F 1/24 210/151
2015/0041376 A1 * 2/2015 Fulford ..... C02F 3/103 210/143
2016/0032547 A1 * 2/2016 Armanini ..... E02B 5/085 210/747.5

* cited by examiner

SYSTEM FOR AERATION AND SEPERATION OF CONTAMINANTS FROM FLOWING WATER

FIELD OF INVENTION

System for aeration and separation of contaminants from flowing water of water bodies like rivers, runnels and canals.

BACKGROUND OF THE INVENTION

Water aeration is required in water bodies that suffer from anoxic conditions, caused due to adjacent human activities such as sewage discharges, agricultural run-off and industrial waste discharges into the river. Aeration can be achieved through the infusion of air into the bottom of the river.

Dissolved oxygen is a major contributor to water quality. It's not only crucial for aquatic life but also oxygen breathing for aerobic bacteria that decompose organic matter. When oxygen concentrations become low, anoxic conditions develop that decrease the ability of the flowing water body to support life.

Oxygen can be driven into the water when the wind disturbs the surface of the water body and natural aeration can occur through a movement of water caused by an incoming stream, waterfall, or even a strong flood.

The invention increases the speed and distance travelled by water, increases the water oxygen level, separates and traps the contaminating agents and wastes.

Several attempts have been made to develop an apparatus to aerate flowing water bodies and to separate the contaminants.

Some of relate patents are as follows.

U.S. Pat. No. 7,074,328B2 patent is a mixing, aerating or oxygenating apparatus to aerate or oxygenate ponds, rivers or lakes, sewage or effluent treatment lagoons or beds or to airstrip volatile compounds from water or other solutes by distributing gas through a piped system having a plurality of outlets branching from a common distribution line. In order to deliver a desired quantity of air or oxygen at each outlet, a constant flow regulator is disposed in each outlet which limits the flow to a set amount when the pressure in the pipe system exceeds a predetermined minimum value. In one embodiment, the regulator is chosen to achieve this irrespective of pressure drop along the distribution line. In another embodiment, the regulator is chosen to give the desired output with no pressure drop along the distribution line.

According to U.S. Pat. No. 5,514,285 A, New techniques and means for their utilization are described for substantially improving gas to liquid transfer including aeration of hydroelectric project tail waters and treatment of sewage sludge and sewage treatment effluent or other wastewaters. Liquid flow is directed over an infuser device to separate the liquid into a plurality of free-falling curtains disposed to impinge upon a collection pool there beneath wherein a substantial number of gas bubbles entrained by any particular curtain are acted upon by successive impingements of downstream curtains to effect turbulent interaction, shearing, and re entrainment of such bubbles and substantially increase the residence time thereof in the resulting recombined flow.

According to U.S. Pat. No. 3,462,132 A, A system for surface aeration of water, particularly for aeration or cleaning the water in rivers, lakes, creeks, or along beaches and shores, by means of an aeration rotor mounted on a rotating carrier frame for at least partial immersion into the water to be aerated, said carrier frame being arranged to be anchored at any desired location along a shore where the water is to be aerated.

Hence, there was felt a need for an efficient system for aeration and separation of contamination from flowing water of water bodies like river, runnel and canals which can overcome the disadvantage of the prior art.

OBJECT OF THE INVENTION

An object of the present invention is to provide utmost aeration to the flowing water body without use of any external energy or manpower.

Another object of the present invention is to make the water in the flowing water body cover maximum distance and make it gurgle to maximise the aeration.

Still another object of the present invention is to provide a sink at intervals to remove the silt from the flowing water.

Yet another object of the present invention is to provide a mesh at intervals to separate plastic, tins, weeds and other wastes from the flowing water and remove it manually.

Still another object of the present invention is to provide a system having low cost of installation and is environmental friendly.

Yet another object of the present invention is to provide a technology that improves ground water recharge and water quality.

Still another object of the present invention is to provide an aesthetical view to the river.

Yet another object of the present invention is to reduce the chances of floods caused due to clogging of canals and river.

Still another object of the present invention is to provide an obstruction mesh and wall to reduce the duckweed and unwanted weeds by preventing them from flowing forward and thus reducing the population of mosquitoes and other insects.

Yet another object of the present invention is to prevent the high amounts of silt and contaminants from flowing into dams and river beds that decrease the containing capacity of the water bodies.

Still another object of the present invention is to provide a durable structure to reduce the heavy recurring expenses of cleaning.

Yet another object of the present invention is to reduce the expenses of drinking water treatment.

An added object of the present invention is to provide a cost effective option compared to river cleaning expenses.

BRIEF DESCRIPTION OF THE FIGURES

Other aspects of the invention will become apparent by consideration of the accompanying drawing and their description stated below, which is merely illustrative of a preferred embodiment of the invention and does not limit in any way the nature and scope of the invention.

DETAILED DESCRIPTION

The invention will now be described with reference to the accompanying drawings which do not limit the scope and ambit of the invention. The description provided is purely by way of example and illustration.

Figure 1:
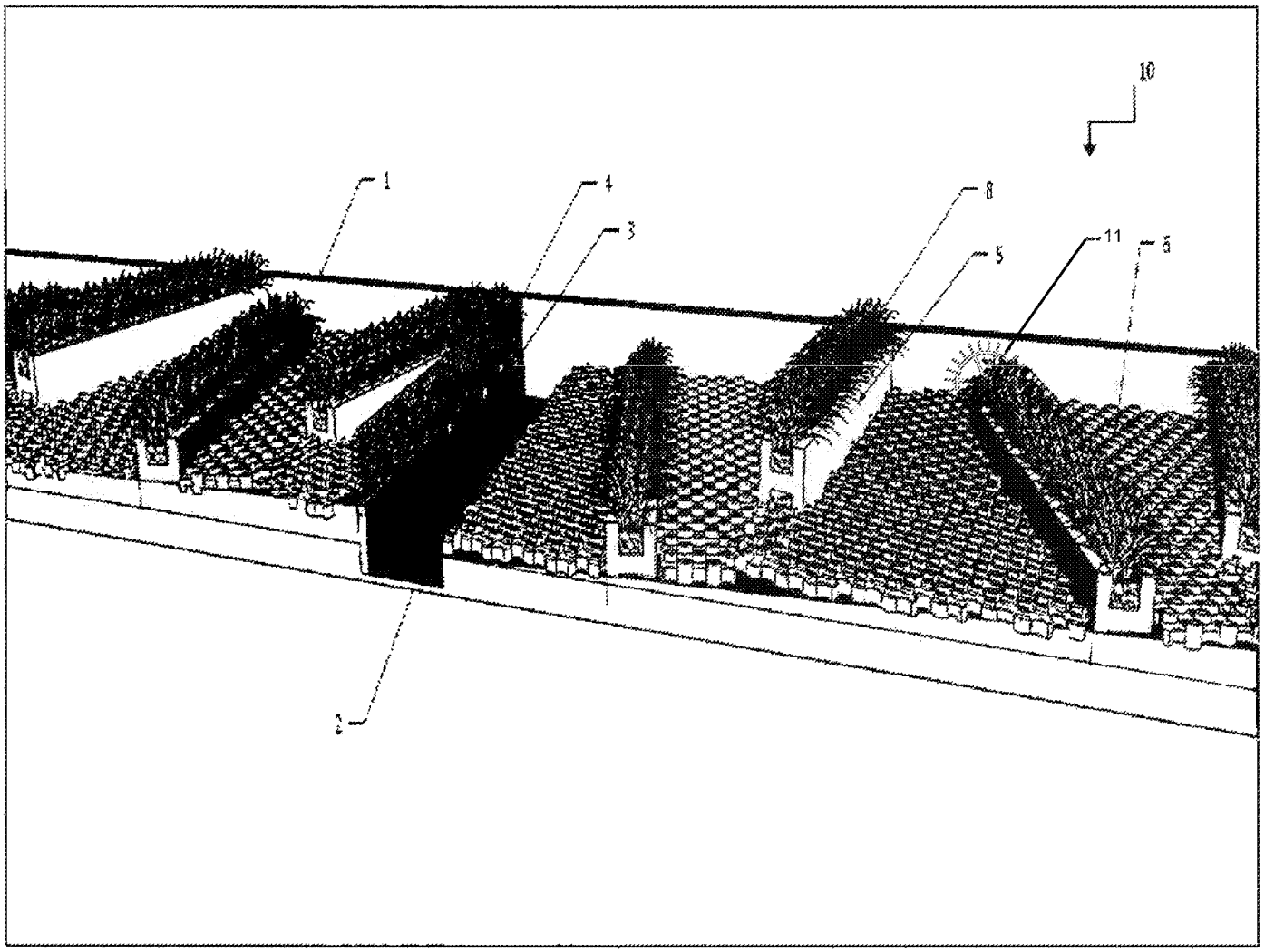
FIG. 1 illustrates cross-section water bodies like rivers, runnels and canals without water in accordance with the present invention.
Figure 3:
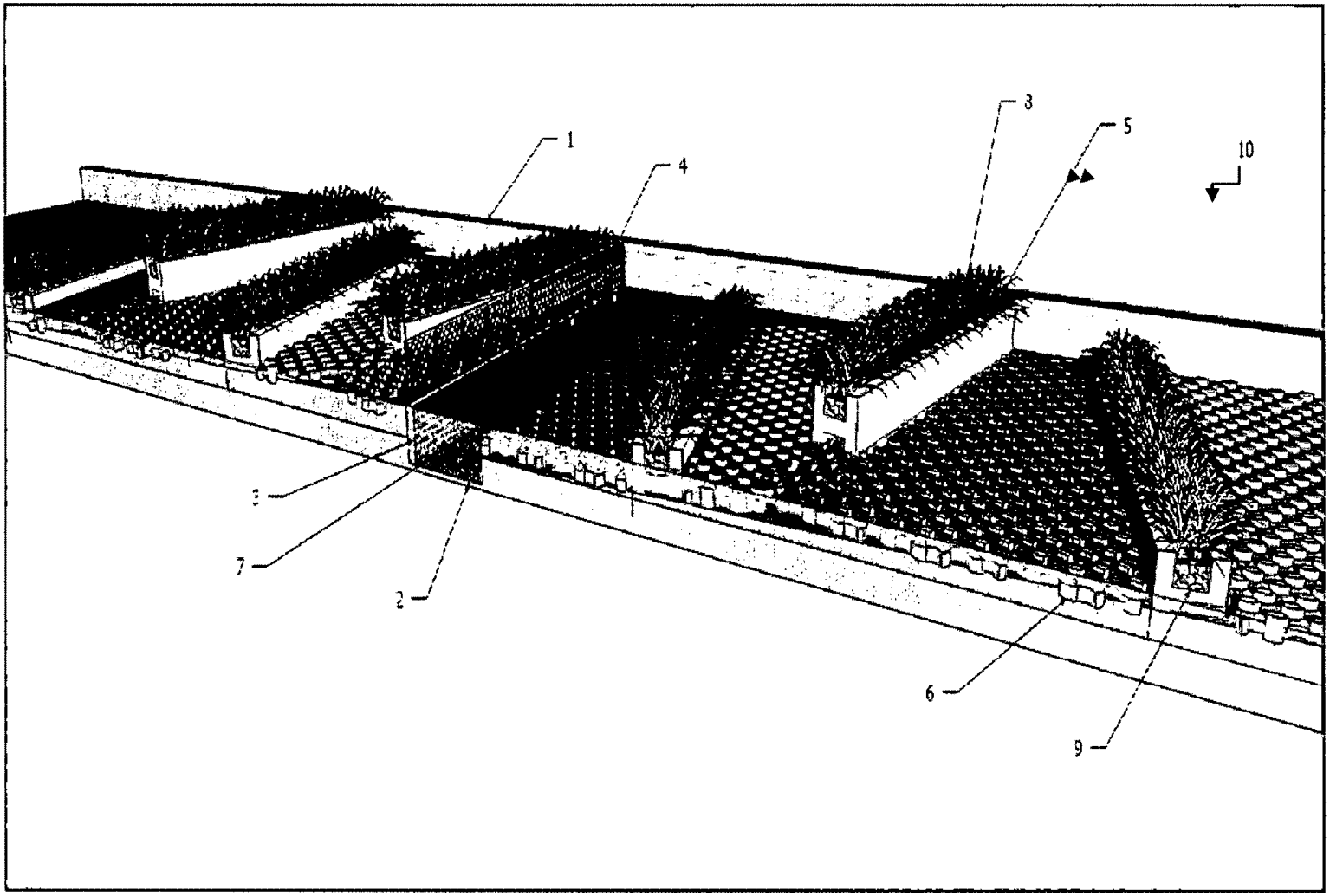
FIG. 3 illustrates cross-section of water bodies like rivers, runnels and canals with water in accordance with the present invention.
Figure 4:
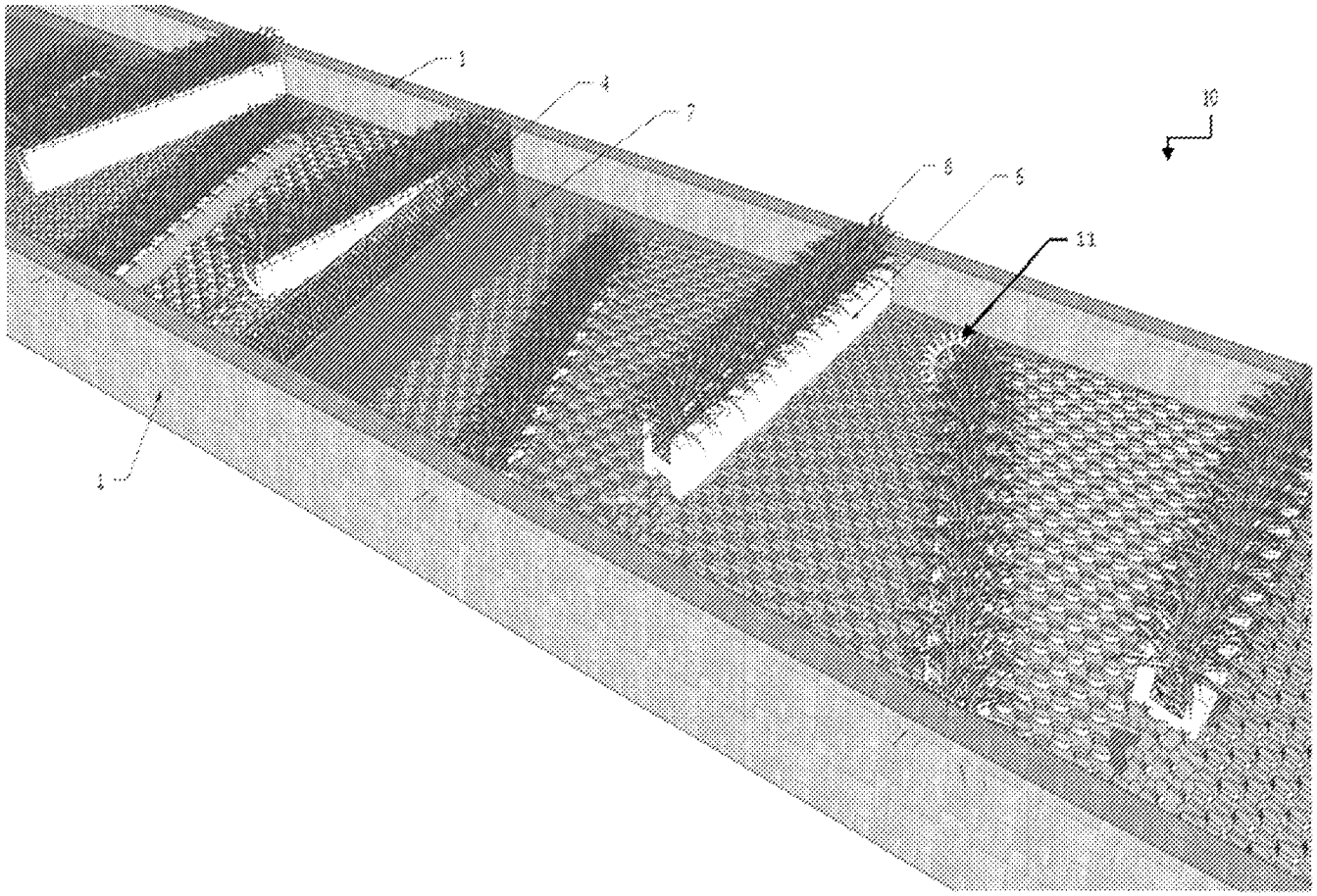
FIG. 4 illustrates a perspective view of water bodies like rivers, runnels and canals in accordance with the present invention.

Referring to the accompanied drawings, a system for aeration and separation of contaminants from flowing water in accordance with this invention is generally indicated by the reference numeral 10 and is particularly shown in FIG. 1,3 and FIG. 4 of the drawing.

System for aeration and separation of contaminants from flowing water (10) in accordance with the present invention typically comprises of a baffle (3), up and down flooring (6), sink (2) and mesh (4).

FIG. 1 illustrates a cross-section of river/runnel/canal (10) without water and no natural channelization, where 4-5 feet wall (1) is built for channelization. The wall (1) is built with bricks/stones/prefabricated blocks/reinforcement concrete blocks for channelization. The building of channel and its calculations depend on the water body, the amount of water flowing and water carrying capacity according to season change. Generally, one-third of the width of the water body is channelized. A 2-3 feet tall H shape baffle (3) is placed between the channelization to act as an obstruction to the flowing water and to collect mud, silt and other forms of wastes in the sink (2). The sink (2) is at a depth lower than the floor (6). A trolley/gate or other mechanism like conveyor belt system can be made to clean the sink (2) manually, semi automatically or automatically.

A sliding mesh (4) is present above the wall to trap wastes like plastic, tins, weeds and other floating wastes. The sliding mesh (4) can be made in a C shape for the convenience in cleaning the waste. The sliding mesh operated manually, semi automatically or automatically. A different type of mesh is used that allows fish to pass through.

Figure 2:
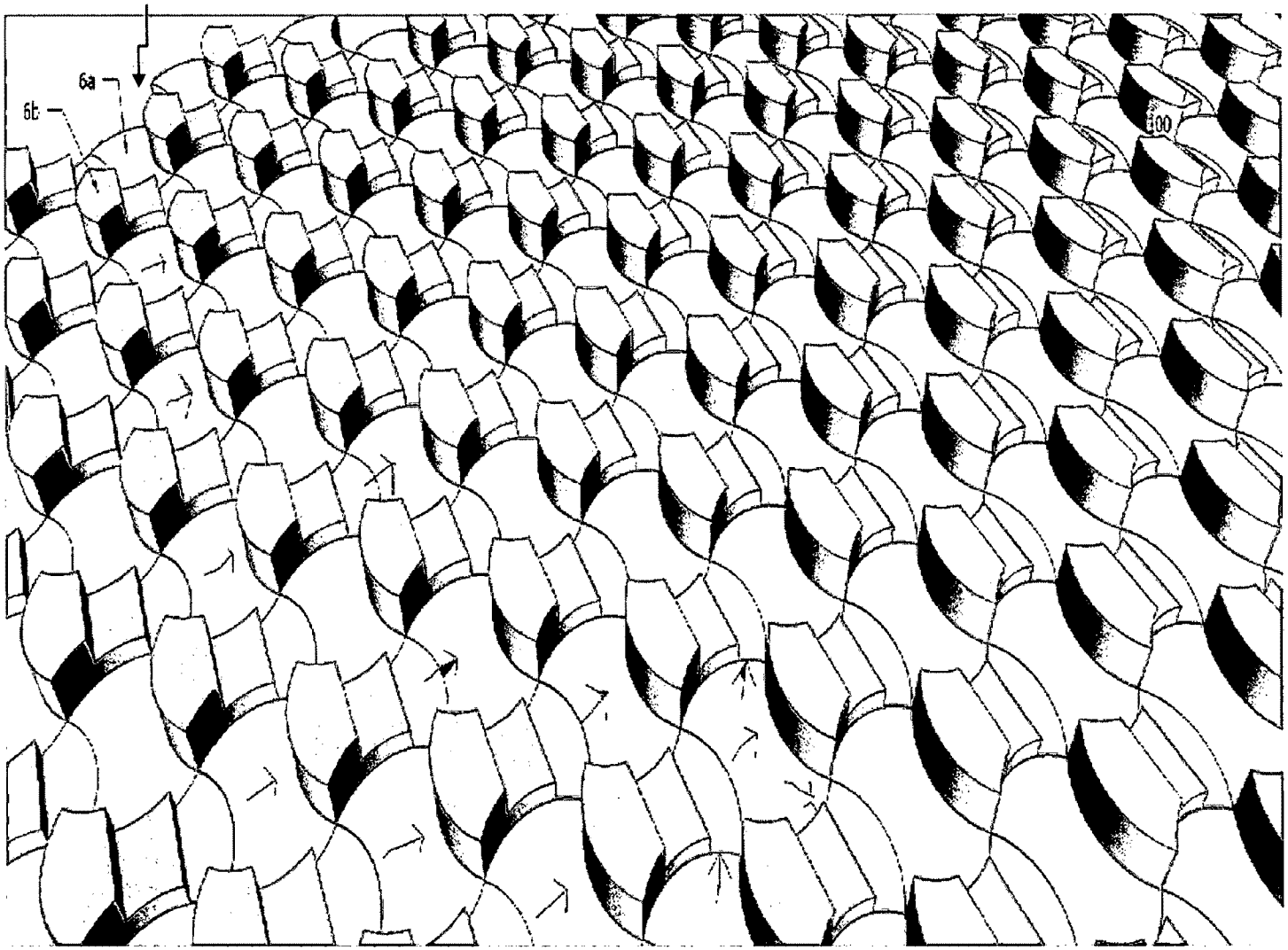
FIG. 2 shows a up-and-down flooring of paving blocks, in water bodies like rivers, runnels and canals in accordance with the present invention.

FIG. 2 illustrates the flooring (6) is an up and down surface in such a way that alternate paving blocks have three steps—100 mm, 80 mm and 60 mm (6*b*) while the remaining paving blocks have 60 mm height (6*a*). The flooring (6) makes the water hit the baffles and give it a gushing action. The up-and-down flooring (6) causes a gurgling action, thus providing more aeration. The curve shape of the paving block pushes contaminant towards sink and small gap between paving blocks allows filtered water to percolate after passing through sand, stone dust, that are likely to be used as paving block base.

FIG. 3 illustrates a cross-section of river/runnel/canal (10) with water and no natural channelization where 4-5 feet wall (1) is built for channelization. Baffle (5) is sloping towards direction of flow of water, placed at an interval of 5 meters (changeable distance) with a height of 2-3 feet. The construction is in a H-shape so as to hold into the base of the water body firmly. The length of the baffle (5) is $3/4^{th}$ of the width of the channel. On the baffle (5) groove, a row of aquatic plants (8) is planted with the help of pebbles, sand and soil (9). These plants absorb the toxic gases present in the water and adds oxygen to the water. The baffle (5) acts as a barrier for the flowing water (7), making the flowing water (7) change its direction multiple times and providing maximum aeration in minimum distance. Baffles (5) increase the levels of oxygen and separated containments in the sink (2). The orientation of the up and down paving blocks flooring (6) changes according to the direction of the baffle (5) and water flow.

Also, water wheels 11 mounted on the baffles or on channel walls cause aeration and water the aquatic plants.

FIG. 4 illustrates a perspective view of the said system.

Technical Advantages

The system as described herein above offers several advancements over similar products disclosed in the prior art. The present invention works without electricity, unlike any other prior art.

The structure of walls, baffles, paving blocks or brick work and trenches at regular intervals throughout the water body is such that the water has to hit the walls and then pass, increasing the distance travelled by the water. This increases the speed and force of water which also makes sure that the water gushes and not moves slowly. Hence, the entire water is aerated and the oxygen level of the water is increased.

The gushing water hits the obstruction and reduces duckweeds and other unwanted weeds from flowing forward. The mesh placed at the intervals traps plastic, tin cans, bottles and other wastes and stops them from flowing ahead.

The materials used for building the blocks are such that the water can percolate through them, thus this technology is absolutely environment friendly.

The construction being impermanent and removable, it can be removed with ease without further damage, if unsuitable.

Economic Significance

The present invention works on the placement of brick construction, trenches and walls at regular intervals throughout the flowing water body. Unlike any other prior art, this technology doesn't require any source of electricity or alternate form of energy or complex structure and maintenance.

The trapped waste like plastic, tins and other wastes and weeds need to be removed manually every month. The well placed trenches, walls and meshes reduce cleaning expense, time and manpower drastically.

The invention claimed is:

1. A system for aeration and separation of contaminants from flowing water that provides clean water and reduces contamination in a channel of flowing water, said system comprising:

a. a wall (1) partially embedded in the channel of flowing water;

b. a mesh (4) placed above said wall (1);

d. a plurality of baffles (3, 5) partially embedded in said channel and placed opposite to each other in such manner so as to increase the distance travelled by said water;

f. plants or algae planted around and on said baffles (3, 5);

h. a flooring (6) sloping towards flowing water direction;

i. a sink (2) constructed at a depth lower than said flooring (6); and j. a water wheel (11) placed in flowing water.

2. The system for aeration and separation of contaminant from flowing water as claimed in claim 1, wherein said contaminated flowing water is water of river, canal, and runnel.

3. The system for aeration and separation of contaminant from flowing water as claimed in claim 1, wherein said wall (1) is made of precast block, bricks, reinforced concrete, precast reinforced concrete block, and stone.

4. The system for aeration and separation of contaminant from flowing water as claimed in claim 1, wherein said mesh (4) is mounted on said wall (1) or fitted with sliding arrangement, operated manually, semi automatically or automatically.

5. The system for aeration and separation of contaminant from flowing water as claimed in claim 4, wherein said mesh (4) is of C shape or straight shape, at least in one part.

6. The system for aeration and separation of contaminant from flowing water as claimed in claim 1, wherein said baffle (3, 5) is made of precast block, bricks, reinforced concrete, precast reinforced concrete block, and stone.

7. The system for aeration and separation of contaminant from flowing water as claimed in claim 1, wherein separated contaminants collected in said sink (2) are removed manually, semi automatically or automatically.

8. The system for aeration and separation of contaminants from flowing water as claimed in claim 1, wherein said flooring (6) is an up-and-down step flooring made with combination of interlocking stepped and flat blocks.

9. The system for aeration and separation of contaminant from flowing water as claimed in claim 8, wherein said up and down step flooring is made up of bricks, stone, and concrete.

10. The system for aeration and separation of contaminant from flowing water as claimed in claim 1, wherein said water wheel (11) is mounted on a baffle (5).

11. The system for aeration and separation of contaminant from flowing water as claimed in claim 1, wherein said water wheel (11) is mounted on said channel.

* * * * *